US006129304A

United States Patent [19]

Biagiotti

[11] Patent Number: 6,129,304

[45] Date of Patent: Oct. 10, 2000

[54] SLITTER REWINDER MACHINE FOR PRODUCING REELS OF WEBLIKE MATERIAL AND ASSOCIATED METHOD

[75] Inventor: Guglielmo Biagiotti, Capannori Lucca, Italy

[73] Assignee: Agfa-Gevaert, N.V., Mortsel, Belgium

[21] Appl. No.: 09/297,222

[22] PCT Filed: Jul. 2, 1998

[86] PCT No.: PCT/IT98/00185

§ 371 Date: Oct. 7, 1999

§ 102(e) Date: Oct. 7, 1999

[87] PCT Pub. No.: WO99/02439

PCT Pub. Date: Jan. 21, 1999

[30] Foreign Application Priority Data

Jul. 11, 1997 [IT] Italy ..... FI97A0166

[51] Int. Cl.[7] ..... B65H 18/08

[52] U.S. Cl. ..... 242/530.1; 242/542

[58] Field of Search ..... 242/530, 530.1, 242/530.4, 542; 83/54, 188

[56] References Cited

U.S. PATENT DOCUMENTS 4,422,588 12/1983 Nowisch .
4,695,006 9/1987 Pool .

FOREIGN PATENT DOCUMENTS 0767123 4/1997 European Pat. Off. .

*Primary Examiner*—John Q. Nguyen
*Attorney, Agent, or Firm*—Breiner & Breiner

[57] ABSTRACT

The machine comprises: a pair of winding rolls (1, 3) defining a winding cradle (5); feed means (13) for feeding a weblike material (N) toward said cradle (5); slitter means (14) for slitting said weblike material (N) lengthwise; insertion means (55) for inserting a plurality of axially aligned tubular winding cores (A) into said winding cradle (5); and a slitting station (49, 51) situated upstream of said winding rolls (1, 3), with a plurality of tools (67) for dividing, at right angles to its axis, a tube (T) of great length into tabular cores (A) of limited length. The slitting station (49, 51) contains a mandrel (71) with means for inserting said mandrel (71) into said tube (T) and for withdrawing the mandrel from the tubular cores obtained by dividing up said tube.

5 Claims, 2 Drawing Sheets

SLITTER REWINDER MACHINE FOR PRODUCING REELS OF WEBLIKE MATERIAL AND ASSOCIATED METHOD

DESCRIPTION

1. Technical Field

This invention relates to a machine for producing reels of wound weblike material, for example paper, tissue paper, nonwovens and similar products.

More specifically, this invention relates to a machine for simultaneously producing a plurality of reels on a corresponding plurality of tubular winding cores arranged in axial alignment in a winding cradle formed by rotating cylinders.

The invention also relates to a method for producing a plurality of reels of weblike material wound on tubular cores.

2. Background Art

In the paper converting industry it is frequently necessary to produce relatively large diameter reels of paper wound on tubular winding cores. This requirement occurs, for example, when manufacturing reels of toilet paper, paper towels and the like for industrial use or public facilities, that is to say where there is a need for reels containing a large quantity of wound paper.

Many different types of machine, in which one or more tubular winding cores are laid in a cradle formed by two rotating winding rolls, have been designed for the production of these reels. GB-A-2,050,317 discloses a machine that produces one reel at a time on a tubular core. The core is placed in a lateral jaw which, at the start of the winding cycle, places the core (to which a band of adhesive has already been applied) in the winding cradle.

A similar machine is disclosed in U.S. Pat. No. 4,456,190.

U.S. Pat. No. 3,727,854 discloses a machine in which the winding cores are inserted in sequence in the winding cradle by a chain hoist and a pivoting insertion means.

In some cases two or more cores are laid in the winding cradle in axial alignment. The weblike material is then slit lengthwise on its way to the winding rolls. The result is simultaneous winding of two or more reels in parallel. This makes it possible to wind reels of considerable diameter and with an axial dimension equal to the final dimension which it is desired to produce, thereby avoiding the necessity of cutting the reels after winding. Such a machine is produced by the company Jagenberg Aktiengesellschaft, Düsseldorf, Germany, and is known by the name "Vari-Dur".

Other examples of machines in which winding takes place simultaneously on two or more axially aligned tubular cores are disclosed in Japanese Utility Model Application JP 54-4806 and in U.S. Pat. No. 4,157,794.

In these machines the tubular cores are supplied already in the axial dimension on which winding is carried out.

A production machine belonging to the present proprietor, by the name "Rodumat", also has a slitting station in which a tube of board or other suitable material is slit into a plurality of tubular cores of reduced length, which are then inserted into the winding cradle. In this machine a mandrel is inserted into the tube in the slitting station to serve as a backing for the slitting tools, after which the mandrel, now inside the tubular cores generated by the slitting of the tube is inserted into the winding zone for the formation of the reels of weblike material. After winding, the mandrel is withdrawn and sent via a recycling path to the slitting station. With these machines it is therefore necessary to have a large number of mandrels, two systems for inserting and withdrawing the mandrel at two different points of the machine and a mandrel recycling path.

OBJECTS OF THE INVENTION

It is an object of this invention to provide a rewinder machine for simultaneously producing a plurality of reels on axially aligned cores that is highly compact and efficient.

It is also an object of the invention to provide a rewinder machine that also comprises, in line with the feed means of the weblike material, means for the precise and efficient slitting of tubes to produce tubular cores of the desired length for winding.

It is yet another object of the invention to provide a machine in which it is possible quickly and flexibly to modify the length of the individual tubular cores to suit production needs.

SUMMARY OF THE INVENTION

These and other objects and advantages, which will be clear to those skilled in the art upon reading the following text, are achieved with a rewinder machine for producing reels of weblike material, of the type comprising a pair of winding rolls defining a winding cradle, feed means for feeding a weblike material toward said cradle, slitter means for slitting said weblike material lengthwise, insertion means for inserting a plurality of axially aligned tubular winding cores into said winding cradle, and a slitting station situated upstream of said winding rolls, with a plurality of tools for dividing, at right angles to its axis, a tube of great length into a plurality of tubular cores of limited length.

Characteristically, according to the invention, the slitting station contains a mandrel and means of insertion of the mandrel into the tube to be slit and of withdrawal of the mandrel from the tubular cores obtained by dividing up said tube before the cores are removed from the slitting station.

The result is a machine with all the advantages of rewinders in which the tube is slit, with the assistance of a mandrel inserted axially into it, immediately upstream of the winding zone. However, the disadvantages of having to withdraw the mandrel at the end of the winding process and recycle the withdrawn mandrels from the reel ejection station to the slitting station, are eliminated.

Hereinbelow, for the sake of clarity, the term "tube" will be used to denote the tubular core before it is divided at right angles to its axis, while the term "tubular core" will denote the core obtained by the division of the tube.

It should be understood in addition that the slitting of the tube in the slitting station may be such as to generate physically separate tubular cores or else simply a slit in the form of perforations, giving the tube a series of annular perforations or incisions in planes at right angles to the axis where the individual tubular cores will be separated later, possibly after the material has first been wound onto them. In this way a tube is transferred from the slitting station to the winding cradle with a series of incisions or perforations that divide it up into lengths, each length giving rise, subsequently, to a corresponding tubular core when the incision or perforation is broken. In the following text the term "slit" will denote in a general way any action tending to divide the tube into a series of lengths that give rise, at any stage in the production process, to a series of tubular cores. The term "tubular cores" is used to indicate all of the lengths into which the tube is divided, even if these lengths have not yet been separated from each other but are simply defined by lines of incisions or perforations.

Other advantageous features of the machine and method according to the invention are indicated in the accompanying claims and will be described in greater detail with reference to an example of an embodiment.

BRIEF DESCRIPTION OF THE DRAWINGS

A clearer understanding of the invention will be provided by the description and the accompanying drawing, the latter showing a practical, non-restrictive example of said invention. In the drawing.

DETAILED DESCRIPTION OF THE PREFERRED EMBODIMENT OF THE INVENTION

Figure 1:
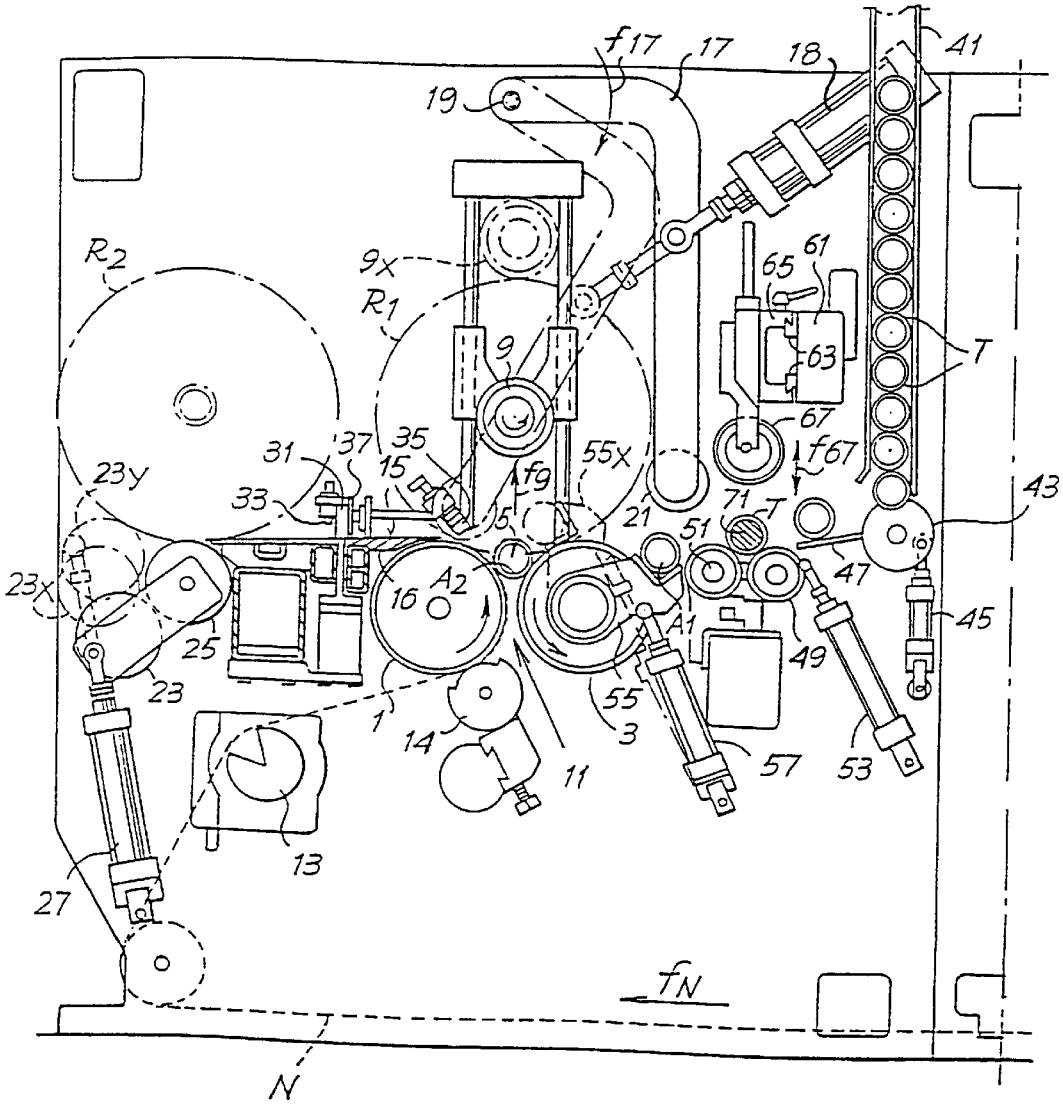
FIG. 1 shows a schematic side view of the machine according to the invention.

Referring initially to FIG. 1, the machine comprises a pair of winding rolls 1 and 3 on parallel axes and positioned alongside each other to form a winding cradle 5. Arranged above the winding cradle is a third roll 9 that can move vertically as shown by the arrow f9. The three rolls 1, 3, 9 form a winding space in which the reels of weblike material are formed around the tubular cores A, which are inserted when required into the winding cradle 5 in the manner described later.

The weblike material N is fed from below through the gap 11 defined between the two winding rolls 1, 3. Along the path of the weblike material are a spreader roll 13 and a series of cutters 14 that act in combination with annular grooves formed in the winding roll 1 in order to slit the weblike material N into strips that are narrower than the total width of the weblike material N. To the side of the rolls 1, 3 is an ejection apron 15 onto which the completed reels are unloaded.

In FIG. 1 a series of completed reels, axially aligned and ready for ejection, are indicated at R1. The reels R1 are moved off the cradle 5 onto the ejection apron 15 by a pivoting arm 17 hinged at 19 to the structure of the machine, its pivoting movement being controlled by a piston/cylinder actuator 18. The pivoting arm 17 carries an idle roller 21 at its free end to act on the surface of the reels R1 and eject them.

The ejection apron 15 slopes away slightly and at its lower end are two cylinders 23, 25 side by side. The cylinder 25 is on a fixed axis while the axis of the cylinder 23 can pivot about the axis of the cylinder 25 and its pivoting movement is controlled by a piston/cylinder actuator 27. The cylinder 23 can adopt three different positions relative to the cylinder 25, one of which is indicated in solid lines in FIG. 1, while the other two are drawn in broken lines and labeled 23X and 23Y. One or both of the cylinders 23, 25 is/are motorized. The function of the pair of rolls 23, 25 will be explained later in further detail.

In the ejection apron 15 is a transverse slit along which travels a carriage 31 that can traverse the ejection apron 15 in an substantially perpendicular direction to the direction in which the reels roll over the apron 15.

The carriage 31 carries a first nozzle 33 and a second nozzle 35 for applying a suitable adhesive to the weblike material and to the tubular winding cores in the manner described below. The carriage 31 also carries a cutter 37 that slits the weblike material when winding is complete.

At the opposite side of the machine from the ejection apron 15 are means for feeding and slitting the tubes and inserting the tubular winding cores. These means comprise a magazine 41 containing a plurality of tubes T (made of board, for example) that can be fed directly from a tube machine in which they are made, or from a larger store. At the lower end of the magazine 41 a pivoting distributor 43 controlled by an actuator 45 takes the tubes T one by one from the magazine 41 and unloads then onto a ramp 47. At the end of the ramp 47 is a pair of cylinders 49, 51 side by side and on parallel axes. The cylinder 51 is on a fixed axis while the cylinder 49 can pivot with its axis about the axis of the cylinder 51. This pivoting movement is controlled by a piston/cylinder actuator 53. One or both of the cylinders 49, 51 are motorized and carry out the slitting of the tubes T so as to form tubular cores of the required lengths, in the manner described later in greater detail.

Downstream of the pair of cylinders 49, 51 is an insertion means 55 that pivots about the axis of the winding roll 3, the pivoting movement being controlled by a piston/cylinder actuator 57.

Situated above the pair of cylinders 49, 51 is a beam 61 with a dovetail track 63 running crosswise relative to the weblike material N. Sliders 65 are positioned and locked at points along the track 63 and each carries its own slitting tool 67, in the form of a slitting disk, that can be raised and lowered as shown by the double arrow f67. Each slitting disk is mounted idly on its own spindle.

Figure 2:
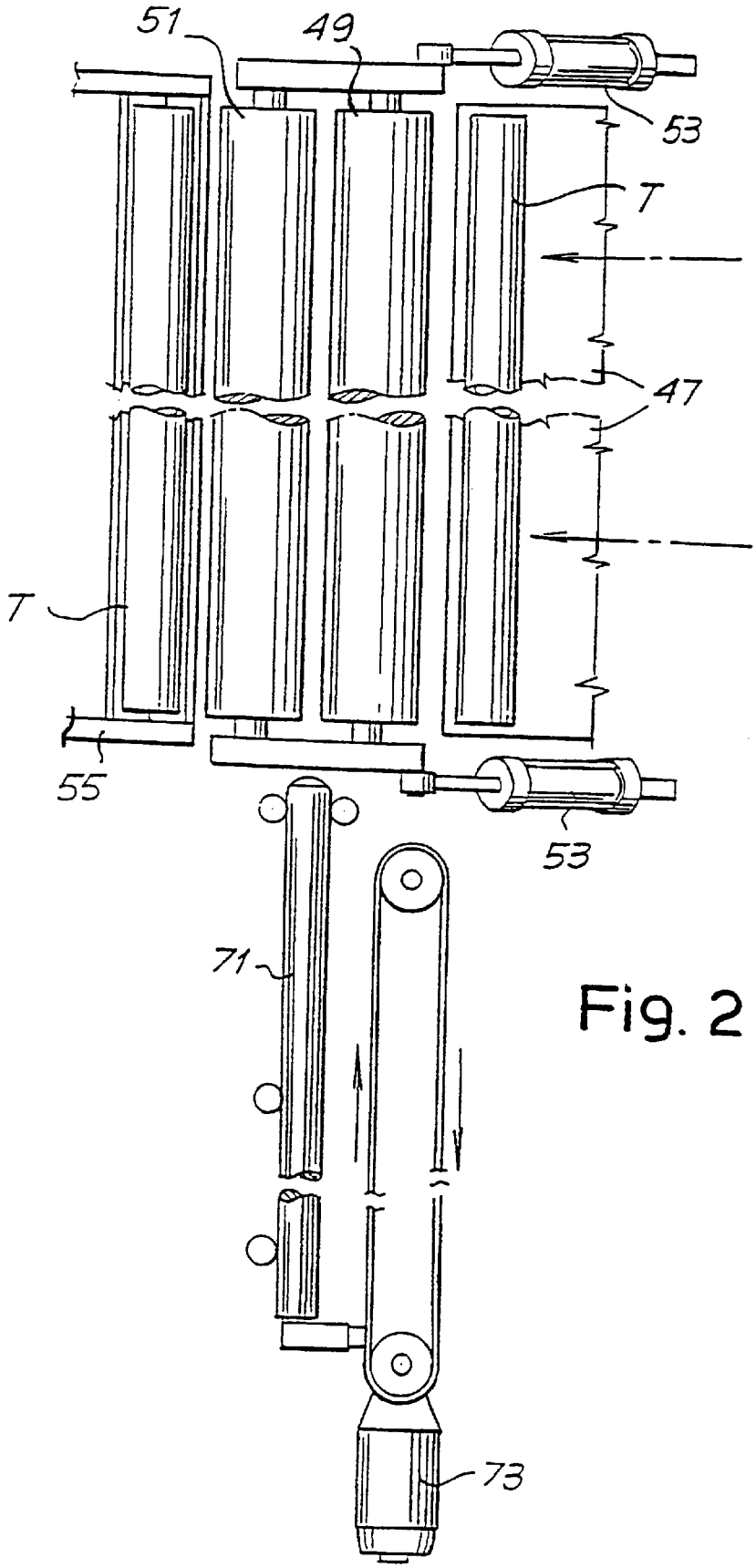
FIG. 2 shows a plan view of the zone in which the tubular cores are slit.

The machine as described thus far works in the following manner: the distributor 43 takes a tube T from the magazine 41 and unloads it onto the ramp 47; the tube T positions itself in the cradle between the cylinders 49 and 51, and in this position a cylindrical mandrel 71 (see also FIG. 2) is inserted into the tube T by an actuator 73. The mandrel 71 has a diameter slightly smaller than the internal diameter of the tube T so as to enable it to be inserted and withdrawn with ease.

Once the mandrel 71 has been inserted into the tube T, the tools 67 are lowered and pushed against the tube so as to penetrate into the thickness of the board (or other suitable material, such as plastic for example) forming the tube T. The cylinders 49, 51 are rotated so as to turn the tube T and the mandrel inside it, which for this purpose is supported cantilever-fashion on support bearings allowing it to rotate easily about its own axis.

The tubes T are thus slit by the tools 67, which act in combination with the mandrel 71, into a plurality of tubular cores A of shorter length, corresponding to the axial length of the reels which it is desired to produce. The presence of the mandrel inside the tube T enables a rapid and precise slit to be made without deforming the tubular material.

As mentioned earlier, the tools 67 may carry out annular perforations, rather than a complete slit, at the lines of breakage of the tube T. The perforations divide the tube into tubular cores which, however, remain attached to each other at the perforations and are separated once the weblike material has been wound onto them.

In addition to the abovementioned slitting, the tools 67 also carry out two lateral slits to eliminate trimmings from the head and tail of the tube. The trimmings are then removed, e.g. by suction means (not shown).

Once the tube T has been divided up into a series of tubular cores A (separated from each other or joined together by lines of perforations produced by the tools 67), the mandrel 71 is withdrawn axially by the actuator 73 to allow unloading of the tubular cores A. These are unloaded onto the insertion means 55 which is in the position indicated in solid lines in FIG. 1. The unloading of the cores A onto the insertion means 55 is effected by pivoting the cylinder 49, by means of the actuator 57, about the axis of the cylinder 51.

Once the slit tubular cores have reached the position indicated at A1 on the insertion means 55, the latter is pivoted in turn by the actuator 57 toward the position indicated in broken lines and marked 55X, where the tubular cores A are unloaded into the cradle 5 between the rolls 1, 3 in position A2. During this stage the rolls 1 and 3 are temporarily stationary and the roll 9 is in the raised position indicated at 9X in broken lines in FIG. 1. The weblike material N winds part of the way around the circumference of the winding roll I and therefore the tubular cores A come into contact with the weblike material when unloaded into the cradle 5.

The position of the cutters 14 and of the slitting tools 67 is such that each tubular core A will correspond to one of the strips produced by the slitting of the weblike material N by the cutters 14.

When the tubular cores A have assumed the position A2, they are given a line of adhesive sprayed by the nozzle 35 mounted on the carriage 31, which for this purpose traverses along the slot in the rolling apron 15. A series of nozzles 16 in the ejection apron 15 emit a jet of air that wraps the resulting edge of material around the tubular cores in position A2. The roll 9 is then lowered into contact with the surface of these tubular cores, which are thus in contact with the three rolls 1, 3, 9. When the three rolls 1, 3, 9 begin to rotate in the same direction as each other, the tubular cores A are rotated and consequently the adhesive applied to them comes into contact with the weblike material, which thus begins to wind itself onto them.

As the rotation of the winding rolls 1, 3, 9 continues, a series of reels R1 is formed, each on its own individual tubular winding core A. While the reels are being formed on the cores A in the winding cradle 5, a fresh tube T is unloaded onto the cylinders 49, 51 to be divided into a new series of tubular cores A which will be inserted into the cradle 5 in the next winding cycle.

On completion of winding, the rolls 1, 3 and 9 are stopped and the pivoting arm 17 is pivoted clockwise, as indicated by arrow f17, by the actuator 18 in order to eject the series of reels R1 onto the ejection apron 15. The reels R1 roll over the apron 15 and stop at the edge of the latter when they encounter the cylinders 25, 23, the latter being for this purpose in position 23Y. R2 identifies the position of the reels R when they finish rolling over the ejection apron 15.

When this position has been reached, the weblike material N is still connected to the reels R2 and must be cut so that winding can be commenced on the next series of tubular cores A, which are brought into the winding cradle 5 in the manner described earlier.

To this end the carriage 31 effects a crosswise stroke in such as way as to carry out three actions simultaneously:

1. to apply, by means of the nozzle 33, a line of adhesive to an area of the weblike material situated between the path of the carriage 31 and the reels in position R2,
2. to cut the weblike material crosswise by means of the cutter 37, and
3. to apply a line of adhesive by means of the nozzle 35 to the new tubular cores which in the meantime have been placed in the cradle 5 in position A2, in the manner described earlier.

After the weblike material has been cut by the cutter 37, the reels R2 are rotated so as also to wind the tail end of weblike material produced by the cutting action of the cutter 37. Because the tail end carries the adhesive applied by the nozzle 33, the rotation of the reels R2 also causes the tail end of these reels to be stuck down and closed.

For this purpose the cylinder 23 is moved into position 23X, in which the axes of the cylinders 23, 25 are substantially leveled up in a horizontal plane. The reels R2 are thus supported by the cylinders 23, 25 alone and not by the ejection apron 15, which means that rotating the cylinders 23, 25 anticlockwise will close the free end of the reels R2.

The reels, now completed and stuck down, are then unloaded onto a conveyor belt or other suitable device (not shown) by moving the cylinder 23 to the position shown in solid lines in FIG. 1. Alternatively, unloading may be by pushing the reel axially with a pusher that traverses between the cylinders 23, 25 parallel to their axes, in which case the distance between the cylinders 23, 25 may be slightly greater.

Given the relatively long winding times required to form the large-diameter reels R, the operations of winding the free ends of the reels in position R2 and slitting the tubes T takes place out of the way of the winding of the reels in the cradle 5.

It should be understood that the drawing shows only an example purely by way of a practical demonstration of the invention, which latter can be varied in its shapes and arrangements without thereby departing from the scope of the concept on which the invention is based. The presence of any reference numerals in the appended claims is for the purpose of facilitating the reading of the claims with reference to the description and drawing and does not limit the scope of protection represented by the claims.

What is claimed is:

1. A rewinder machine for producing reels of weblike material, comprising: a pair of winding rolls (1, 3) defining a winding cradle (5); feed means (13) for feeding a weblike material (N) toward said cradle (5); slitter means (14) for slitting said weblike material (N) lengthwise; insertion means (55) for inserting a plurality of axially aligned tubular winding cores (A) into said winding cradle (5); and a slitting station (49, 51) situated upstream of said winding rolls (1, 3), with a plurality of tools (67) for dividing, at right angles to the axis, a tube (T) of great length into tubular cores (A) each of limited length; characterized in that said slitting station (49, 51) includes a mandrel (71) with means for inserting said mandrel (71) into said tube (T) and for withdrawing the mandrel from the tubular cores obtained by dividing up said tube.

2. The machine as claimed in claim 1, characterized in that said mandrel is supported idly by support means in said slitting station.

3. The machine as claimed in claim 1 or 2, characterized in that said slitting station comprises a pair of cylinders (49, 51) on parallel axes, at least one of which is motorized, the two together defining a cradle in which the tubes to be slit (T) can sit.

4. The machine as claimed in claim 3, characterized in that a track (63) along which the tools (67) are positioned is located above said cylinders (49, 51).

5. A method of producing a plurality of reels of weblike material wound on tubular winding cores (A), comprising the following steps:

positioning a pair of winding rolls (1, 3) side by side to define a winding cradle (5), inserting a series of axially aligned tubular cores (A) into said winding cradle, winding a lengthwise portion of a weblike material (N) onto each of said cores, after winding a series of reels (R1) onto said series of tubular cores (A) in said cradle, ejecting the completed reels and inserting a fresh series of tubular cores, and inserting an axial mandrel (71) into a tube (T) of great length and, with a series of tools (67), dividing said tube at right angles to the axis to produce said series of tubular cores (A), which tools act in combination with said mandrel inserted in said tube;

characterized in that said mandrel is withdrawn from the tubular cores produced by dividing said tube before said tubular cores are inserted in the winding cradle.

* * * * *

UNITED STATES PATENT AND TRADEMARK OFFICE

CERTIFICATE OF CORRECTION

PATENT NO. : 6,129,304
DATED : October 10, 2000
INVENTOR(S) : Guglielmo Biagiotti It is certified that error appears in the above-identified patent and that said Letters Patent is hereby corrected as shown below:

Title Page —
[73] "Agfa-Gevaert, N.V., Mortsel, Belgium" should read
-- Fabio Perini S.p.A., Lucca, Italy --.

Signed and Sealed this

Twenty-sixth Day of June, 2001

*Attest:*

Nicholas P. Godici

*Attesting Officer*

NICHOLAS P. GODICI
*Acting Director of the United States Patent and Trademark Office*